United States Patent [19]

Burton et al.

[11] Patent Number: 5,044,676

[45] Date of Patent: Sep. 3, 1991

[54] TUBULAR THREADED CONNECTOR JOINT WITH SEPARATE INTERFERING LOCKING PROFILE

[75] Inventors: Kevin Burton; David S. Christie, both of Aberdeen, Scotland

[73] Assignee: Abbvetco Gray Inc., Houston, Tex.

[21] Appl. No.: 461,384

[22] Filed: Jan. 5, 1990

[51] Int. Cl.[5] ..... F16L 25/00

[52] U.S. Cl. ..... 285/334; 285/355

[58] Field of Search ..... 285/92, 333, 334, 355, 285/390; 411/338, 339, 508–510; 403/320, 343

[56] References Cited

U.S. PATENT DOCUMENTS

| | | | |
|---|---|---|---|
| 1,344,774 | 6/1920 | Stafford . | |
| 2,160,263 | 5/1939 | Fletcher | 285/333 |
| 4,244,607 | 1/1981 | Blose | 285/92 |
| 4,521,042 | 6/1985 | Blackburn et al. . | |
| 4,525,001 | 6/1985 | Lumsden et al. . | |
| 4,538,840 | 9/1985 | DeLange | 285/333 |
| 4,582,348 | 4/1986 | Dearden et al. . | |
| 4,601,491 | 7/1986 | Bell, Jr. et al. . | |
| 4,610,467 | 9/1986 | Reimert . | |
| 4,624,488 | 11/1986 | Furgerson . | |
| 4,648,627 | 3/1987 | Reimert | 285/92 |
| 4,662,659 | 5/1987 | Blose et al. | 285/334 |
| 4,676,529 | 6/1987 | McDonald | 285/92 |
| 4,707,001 | 11/1987 | Johnson . | |
| 4,717,183 | 1/1988 | Nobileau . | |
| 4,865,364 | 9/1989 | Nobileau | 285/334 |
| 4,902,047 | 2/1990 | Marietta et al. | 285/92 |

FOREIGN PATENT DOCUMENTS

| | | | |
|---|---|---|---|
| 2033518A | 5/1980 | United Kingdom . | |
| 2099529 | 12/1982 | United Kingdom | 285/334 |
| 2146086A | 4/1985 | United Kingdom . | |

*Primary Examiner*—Eric K. Nicholson

*Attorney, Agent, or Firm*—James E. Bradley

[57] ABSTRACT

A connecting joint for connecting two tubular members together has a pin and a box, each containing conical threaded sections. The pin and the box each has a locking section for locking the pin and box together during make-up. Each locking section has at least one circumferential profile with a crest. The crests are dimensioned so that they interfere with each during make-up. A shoulder locates below each crest. This shoulder is conical and opposite to the taper of the threaded section. The decree of taper of this shoulder is high relative to the longitudinal axis of the pin and box, requiring a large breakout force.

4 Claims, 2 Drawing Sheets

TUBULAR THREADED CONNECTOR JOINT WITH SEPARATE INTERFERING LOCKING PROFILE

BACKGROUND OF THE INVENTION

1. Field of the Invention

This invention relates in general to large diameter threaded connectors for the use in offshore drilling and production, and in particular to a means for locking the connectors together when made up.

2. Description of the Prior Art

In offshore drilling, large diameter pipes are used for various purposes. One type of connector joint for connecting the pipes together uses a threaded pin and box member. Often, the threads will be of a multistart type. That is, they will make-up in less than one full turn. This is useful because of wave and current action causing movement of the drilling vessel.

Because this type of connector makes up in less than one turn, there is a need to lock the connector against accidentally releasing. One type of locking device utilizes tabs formed in the rim of the box. These tabs are bent over into slots formed in the pin.

There are patents which show connector joints which have surfaces located above or below the threads and which engage each other in an interference fit. This interference fit would result in a greater requirement for break-out torque, thus making it less likely to unscrew. However, these surfaces also result in a greater requirement for make-up torque.

SUMMARY OF THE INVENTION

In this invention the pin and box each have frusto-conical threaded sections which engage each other. Preferably, these threaded sections have multi-start threads which make-up in less than one turn. Also, each pin and box has a locking section. The locking section of the box has a circumferential profile with a crest that joins on its lower termination a shoulder which faces generally downward.

The locking section of the pin has a profile with a crest that joins on its upper termination an upward facing shoulder. The crest of the box and the crest of the pin are both conical with the same degree of taper. The shoulders of the locking profile are also conical, but they are at a much greater degree of taper than the crests and are reversed in inclination.

The crests are sized so that they will interfere when the pin stabs into the box. This results in the box expanding outward elastically during make-up. The pin crest slides below the box crest and locates in a recess below the box crest at full make-up. The shoulders of the profiles will engage each other at full make-up.

To break-out, the shoulder of the pin must slide up past the shoulder of the crest. Because the degree of taper is much greater than the crest taper, a much larger force is required to break-out than to make-up. The profiles thus lock the connector joint members together automatically during make-up.

DESCRIPTION OF THE PREFERRED EMBODIMENT

Figure 1:
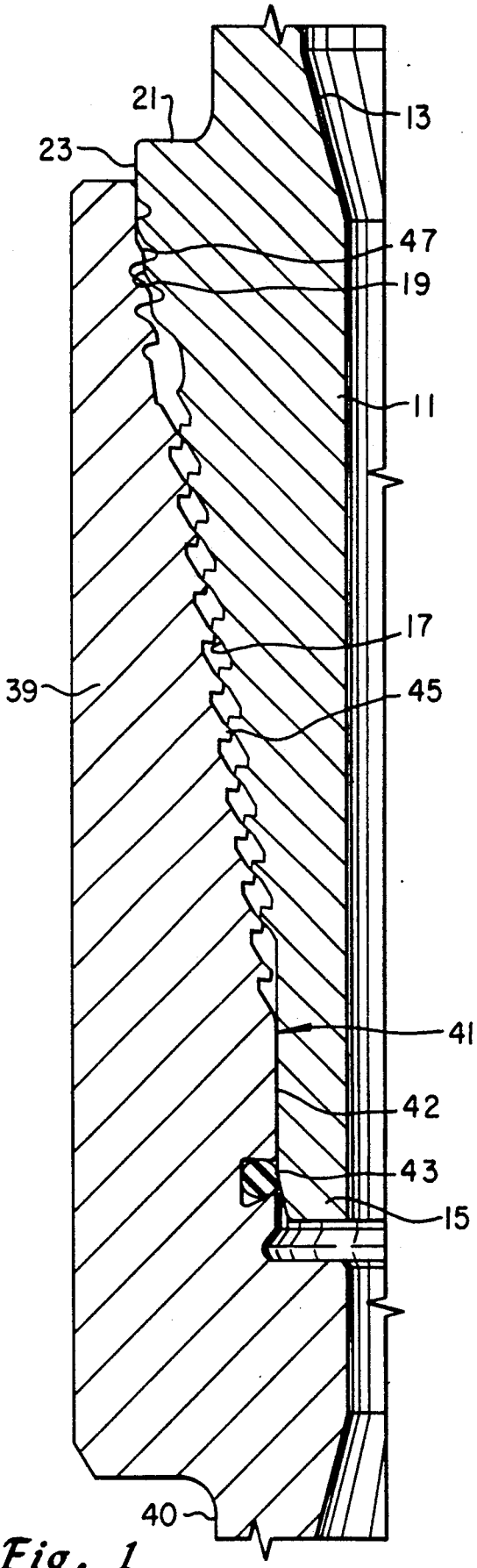
FIG. 1 is a quarter sectional view of a connector joint constructed in accordance with this invention and shown in an initial stab position prior to make-up.

Referring to FIG. 1, the connector joint has a pin 11. Pin 11 has an upper end that joins to a pipe or tubular member 13. The lower end of pin 11 terminates in a cylindrical nose 15. The exterior of pin 11 above nose 15 is frusto-conical.

A set of threads 17 extend upward from the upper end of nose 15. The conical section on which the threads 17 are formed converges in a downward direction at about a ten degree angle relative to the longitudinal axis of pin 11. The threads 17 are preferably of a multi-start type, such as shown in U.S. Pat. No. 4,717,183, Philippe C. Nobileau, Jan. 5, 1988.

Pin 11 also has a locking section 19 located directly above the threads 17. Locking section 19 is also located on a conical portion of the exterior of pin 11, this portion having the same degree of taper as the threads 17. Pin 11 has an external shoulder 21 on its upper end and an exterior cylindrical portion 23 extending downward a short distance from shoulder 21. The upper end of locking section 19 terminates at this cylindrical portion 23.

Figure 3:
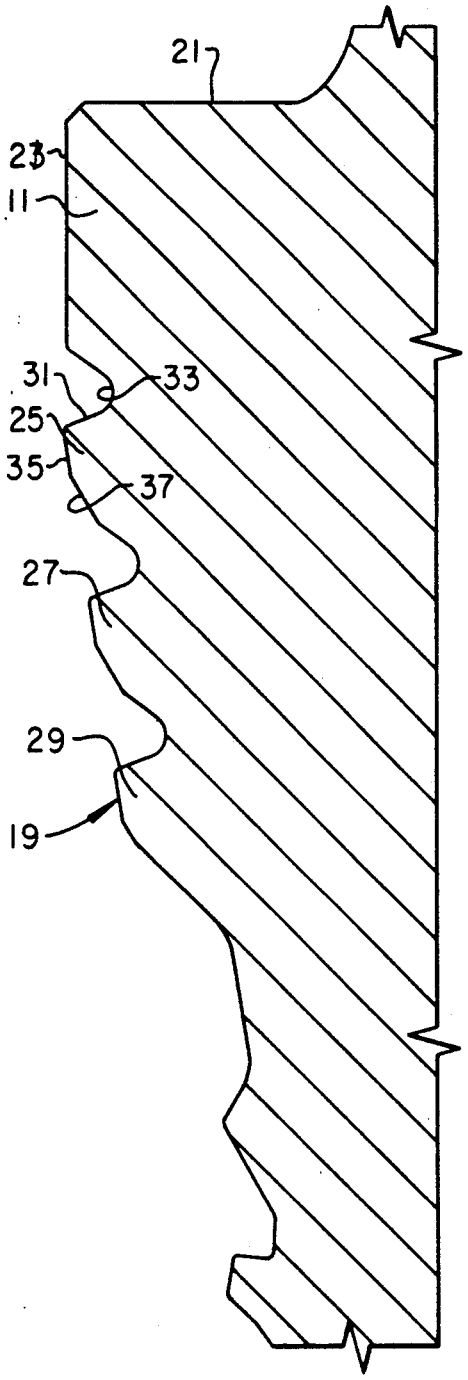
FIG. 3 is an enlarged partial sectional view of the upper portion of the pin of the connector joint of FIG. 1.

Referring to FIG. 3, locking section includes circumferential profiles 25, 27 and 29. Profiles 25, 27 and 29 are not threads, rather each comprises a band or protuberance that extends circumferentially around the exterior of the pin 11 perpendicular to the axis of the pin 11. The profiles 25, 27 and 29 are axially spaced apart from each other and are parallel to each other.

Each profile 25, 27 and 29 has an upward facing shoulder 31. The upward facing shoulder 31 faces generally upward and outward. It diverges in a downward direction. The degree of taper is about 70 degrees relative to the longitudinal axis of pin 11.

Each upward facing shoulder 31 joins a recess 33 on its upper end. The middle recess 33 separates the upper and middle profiles 25, 27 and is curved in cross-section. The lower recess 33 separates the middle profile 27 from the lower profile 29. The upper recess 33 locates above the upper profile 25.

Each upward facing shoulder 31 joins a crest 35 on its lower end. Crest 35 is conical. It converges in a downward direction opposite to the taper of the upward facing shoulder 31. It converges at an angle of about nine degrees relative to the longitudinal axis of pin 11.

The lower end of crest 35 joins a transition section 37. The transition section 37 is also conical and converges in a downward direction. However, it has a greater degree of taper than the crest 35. The taper of the transition section 37 is about 30 degrees relative to the longitudinal axis of pin 11. The transition section 37 joins recess 33 on its lower end.

The diameter of the upper profile 25 is greater than the diameter of the middle profile 27 measured at any point. Also, the diameter of the middle profile 27 measured at any point is greater than the diameter of the lower profile 29. Also, the diameter of the upper recess 33 is greater than the diameter of the middle recess 33, and the diameter of the middle recess 33 is greater than the diameter of the lower recess 33. The differences in diametrical dimensions are proportional to the taper of the locking section 19.

Pin 11 makes up with a box 39. Box 39 joins a tubular member 40 on its lower end. Box 39 has an axial bore 41 extending through it. Bore 41 has a cylindrical section 42 located in the lower portion of box 39. Cylindrical portion 42 contains an elastomeric seal 43 for sealing against the pin nose 15. A set of threads 45 extend upward from the cylindrical section 42. Threads 45 are located on a frusto-conical section of bore 41 for mating with the pin threads 17. A locking section 47 locates above the threads 45.

Figure 2:
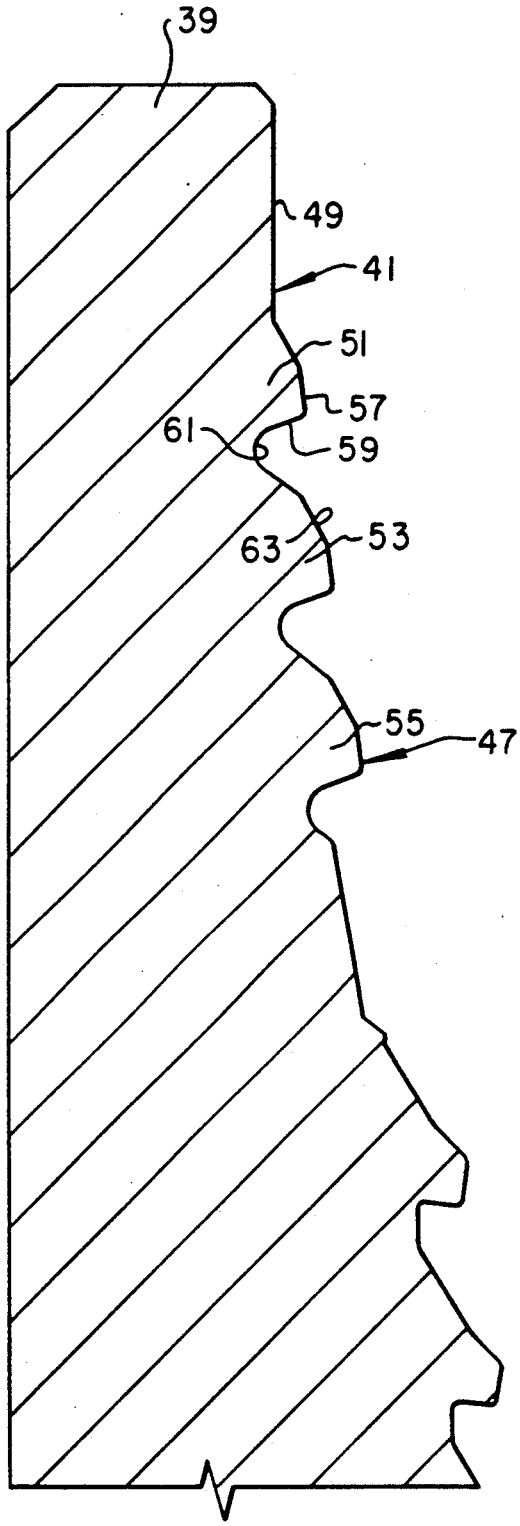
FIG. 2 is an enlarged partial sectional view of the upper portion of the box of the connector joint of FIG. 1.

Referring to FIG. 2, bore 42 has a cylindrical portion 49 located above the locking section 47. The locking section 47 is frusto-conical at the same degree of taper at the conical section that contains the threads 45.

Locking section 47 has three profiles 51, 53 and 55. Profiles 51, 53 and 55 are shaped like the pin profiles 25, 27 and 29 for mating with them. Each of the profiles 51, 53 and 55 has a conical crest 57. Crest 57 converges in a downward direction at an angle of nine degrees relative to the axis of bore 41. Crest 57 joins a downward facing shoulder 59 which diverges in a downward direction. The degree of taper of shoulder 59 is 70 degrees relative to the axis of bore 41. Shoulder 59 joins a curved recess 61 on its lower end. Recess 61 joins a transition section 63 on its lower end. The transition section 63 is conical with a taper of 30 degrees relative to the longitudinal axis of bore 41.

The diameter of the upper profile 51 is greater than the diameter of the middle profile 53 measured at any joint. Also, the diameter of the middle profile 53 is greater than the diameter of the lower profile 55 measured at any point. This is a result of the conical taper of the locking section 19.

In addition, the diameters of the crests 57 of the profiles 51, 53 and 55 will be slightly less than the diameters of the crests 35 of the corresponding profiles 25, 27 and 29. That is, measured at any point, the crest 57 of the upper profile 51 will be slightly less than the diameter measured at the corresponding points of the crest 35 of the upper box profile 25. The difference in the diameter is sized to create an interference when the pin 11 stabs into the box 39, as shown in FIG. 1. The difference in diametrical dimensions is large enough to cause the box 39 to deflect outward during make-up, but not so large as to result in permanent deformation of the box 39. Rather, the deflection is elastic, so that when uncoupled, the box 39 will return to its original dimensions.

In operation, pin 11, will stab into the box 39 and will reach the point shown in FIG. 1 without rotation. The nose 15 will slide into the cylindrical portion 42 of bore 41. The pin threads 17 will contact the box threads 45 but will not be in engagement.

Then, the pin 11 will be rotated relative to the box 39. The threads 17 will engage the threads 45 and cause the pin 11 to move downward relative to the box 39. The crests 35 of the pin profiles 25, 27 and 29 will interferingly engage the crests 57 of the box profiles 51, 53 and 55. The box 39 will expand outward elastically in order to accommodate this interference.

Figure 4:
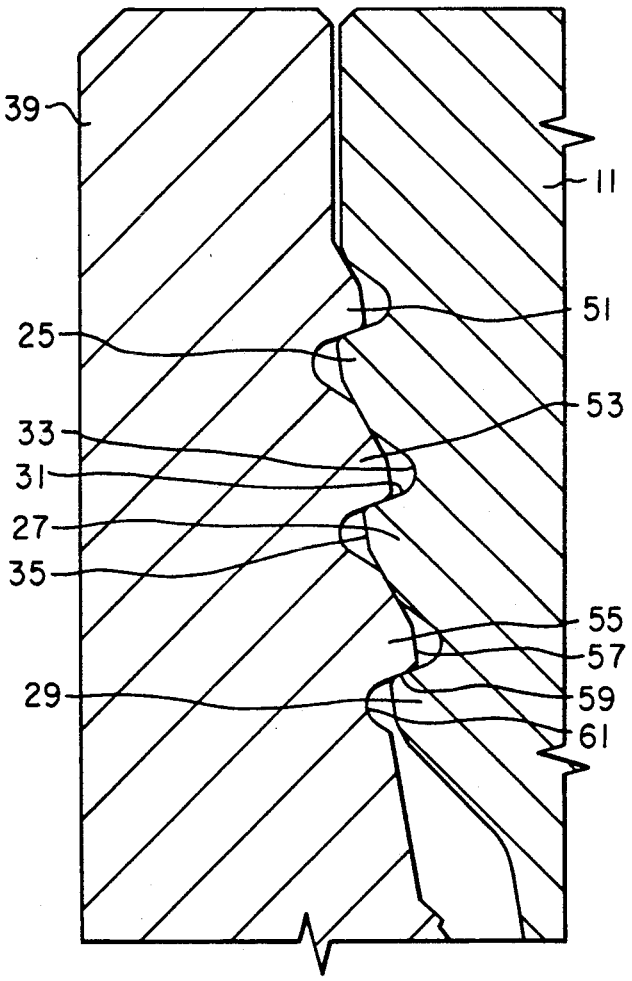
FIG. 4 is a partial sectional view of the upper portions the box and pin of the connector joint of FIG. 1, shown in full make-up position.

The make-up torque will be sufficient to cause the box 39 expansion and to overcome frictional forces of the crests 35 sliding on the crests 57. The threads 17, 45 preferably make-up in less than one turn. The crests 35 will slide downward past the crests 57 during make-up. The pin upper profile 25 will locate in the recess 61 between the box profiles 51 and 53. The pin middle profile 27 will locate in the recess 61 between the box profiles 53 and 55. The lower profile 29 will locate in the recess 61 below the box lower profile 55. Similarly, the box profiles 51, 53, 55 will locate in the pin recesses 33. The pin upward facing shoulders 31 will be located in contact with the box downward facing shoulders 59. This position is shown in FIG. 4.

To break-out pin 11 from the box 39, torque in the opposite direction must be applied. During break-out, as the threads 17 unscrew from the threads 45, the pin 11 will move upward relative to box 39. The pin shoulders 21 will slide past the box shoulders 59. For this to occur, a much larger force must be generated than is required for make-up. This larger force is necessary because the degree of taper of the shoulders 59 is much greater relative to the longitudinal axis than the degree of taper of the crests 57. With sufficient left-hand torque, however, the box 39 will expand outward to allow the shoulders 21 to slide upward past the shoulders 59. The crests 35 will then slide past the crests 57, and the pin 11 may be pulled upward from the box 39.

The intention has significant advantages. The locking profiles actuate automatically as the joint makes up. Much greater torque will be required to break-out the joint than to make-up. This reduces the chance of the joint from accidentally releasing.

While the invention has been shown in only one of its forms, it should be apparent to those skilled in the art that it is not so limited, but is susceptible to various changes without departing from the scope of the invention.

We claim:

1. A connection joint for connecting two tubular members together, comprising in combination:

a pin having a longitudinal axis, the pin being joined to one of the tubular members, the pin having a frusto-conical section containing a set of pin threads, and a locking section spaced axially from the pin threads;

a box having a longitudinal axis, the box being joined to the other of the tubular members, the box having a bore with a frusto-conical section containing a set of box threads for mating with the pin threads, and having a locking section spaced axially from the box threads;

the locking section of the box having at least one circumferential profile which is parallel to a plane perpendicular to the longitudinal axis of the box, the box having a box crest which has a lower termination and which joints on the lower termination of a frusto-conical box shoulder which diverges in a downward direction;

the locking section of the pin having at least one mating circumferential profile which is parallel to a plane perpendicular to the longitudinal axis of the pin and which has a pin crest that has an upper termination and which joins on the upper termination a frusto-conical pin shoulder which diverges in an upward direction at the same taper as the box shoulder;

the box crest having a smaller diametrical dimension than the pin crest so as to cause an interference between the box crest and pin rest as the pin stabs into and is rotated in the box, said diametrical dimensions being selected to cause the box to elastically expand and to cause an increase in make-up torque required to make-up the pin and box threads; and the circumferential profiles of the pin and box being positioned so that the pin and box crests will slide past each other and the pin shoulder will locate below the box crest in contact with the box shoulder as the pin and box threads reach full make-up, the taper of the pin and box shoulders requiring more break-out torque than the make-up torque.

2. A connection joint for connecting two tubular members together, comprising in combination:

a pin having a longitudinal axis, the pin being joined to one of the tubular members, the pin having a frusto-conical section containing a set of pin threads and a locking section spaced axially from the pin threads;

a box having a longitudinal axis, the box being joined to the other of the tubular members, the box having a bore with a frusto-conical section containing a set of box threads for mating with the pin threads, and having a locking section spaced axially from the box threads;

the locking section of the box having at least one circumferential profile which is parallel to a plane perpendicular to the longitudinal axis of the box, the box having a frusto-conical box crest that has a lower termination and converges in a downward direction, the box crest joining on the lower termination a frusto-conical box shoulder which diverges in a downward direction at a greater degree of taper than the box crest;

the locking section of the pin having at least one mating circumferential profile which is perpendicular to the longitudinal axis of the box and which has a frusto-conical pin crest that diverges in a downward direction at the same taper as the box crest, the pin crest having an upper termination which joins a frusto-conical pin shoulder which diverges in an upward direction at the same taper as the box shoulder;

the box crest having a smaller diametrical dimension than the pin crest so as to cause an interference between the box crest and pin crest as the pin stabs into and is rotated in the box, said diametrical dimensions being selected to cause the box to elastically expand and to cause an increase in make-up torque required to make-up the pin and box threads; and the circumferential profiles of the pin and box being positioned so that the pin and box crests will slide past each other and the pin and box shoulders will locate adjacent to each other as the pin and box threads reach full make-up, the greater taper of the pin and box shoulders over the pin and box crests requiring more break-out torque than the make-up torque.

3. A connection joint for connecting two tubular members together, comprising in combination:

a pin having an axis and being joined to one of the tubular members, the pin having a frusto-conical section containing a set of pin threads located above the pin nose, and a frusto-conical locking section located above the pin threads;

a box having an axis and joined to the other of the tubular members, the box having a bore with a frusto-conical section containing a set of box threads for mating with the pin threads, and having a frusto-conical locking section located above the box threads;

the locking section of the box having upper and lower circumferential profiles protruding inward and spaced apart from each other along the axis of the box, each of the upper and lower circumferential profiles being parallel to a plane perpendicular to the axis of the box, the upper and lower circumferential profiles having frusto-conical upper and lower box crests that converge in a downward direction, the upper and lower box crests having lower terminations which join frusto-conical upper and lower box shoulders, each of which diverges in a downward direction at a greater angle relative to the axis of the box than the upper and lower box crests;

the locking section of the pin having upper and lower circumferential profiles protruding outward and spaced apart from each other along the axis of the pin, the upper and lower circumferential profiles of the pin being parallel to a plane perpendicular to the axis of the pin, the upper and lower circumferential profiles of the pin having frusto-conical upper and lower pin crests, respectively, each pin crest having an upper termination and diverging in a downward direction at the same angle as the upper and lower box crests, the upper and lower pin crests joining on the upper terminations frusto-conical upper and lower pin shoulders, each of which diverges in an upward direction at the same angle as the upper and lower box shoulders;

the upper box crest having a larger radial dimension than the lower box crest and the upper pin crest having a larger radial dimension than the lower pin crest;

the upper and lower box crests having smaller diametrical dimensions than the upper and lower pin crests, respectively, so as to cause an interference between the upper box crest and the upper pin crest and the lower box crest and the lower pin crest as the pin stabs into and is rotated in the box, said diametrical dimensions being selected to cause the box to elastically expand and to cause an increase in make-up torque required to make-up the pin and box threads; and the upper and lower circumferential profiles of the pin and box being positioned so that the upper and lower pin and box crest will slide past each other and the upper and lower pin and box shoulders will locate adjacent to each other, respectively, as the pin and box threads reach full make-up, the greater taper of the upper and lower pin and box shoulders over the upper and lower pin and box crests requiring more break-out torque than the make-up torque.

4. A connection joint for connecting two tubular members together, comprising in combination:

a pin having a longitudinal axis and joined to one of the tubular members, the pin having a frusto-conical section containing a set of pin threads located above the pin nose, and a locking section located above the pin threads;

a box having a longitudinal axis and joined to the other of the tubular members, the box having a bore with a frusto-conical section containing a set of box threads for mating with the pin threads, and having a locking section located above the box threads;

the locking section of the box having at least one circumferential profile which is parallel to a plane perpendicular to the axis of the box and which has a frusto-conical box crest, the box crest converging in a downward direction and having a lower termination which joins a frusto-conical box shoulder which diverges in a downward direction at a greater degree of taper than the box crest, the locking section of the box having a recess located below the box shoulder;

the locking section of the pin having at least one mating circumferential profile which is parallel to a plane perpendicular to the axis of the pin, the circumferential profile of the pin having a frusto-conical pin crest that diverges in a downward direction at the same taper as the box crest, the pin crest having an upper termination which joins a frusto-conical pin shoulder which diverges in an upward direction at the same taper as the box shoulder;

the box crest having a smaller diametrical dimension than the pin crest so as to cause an interference between the box crest and pin crest as the pin stabs into and is rotated in the box, said diametrical dimensions being selected to cause the box to elastically expand and to cause an increase in make-up torque required to make-up the pin and box threads; and the circumferential profiles of the pin and box being positioned so that the pin and box crests will slide past each other and the pin and box shoulders will locate adjacent to each other with the crest of the pin locating in the recess of the box as the pin and box threads reach full make-up, the greater taper of the pin and box shoulders over the pin and box crests requiring more break-out torque than the make-up torque.

* * * * *

UNITED STATES PATENT AND TRADEMARK OFFICE

CERTIFICATE OF CORRECTION

PATENT NO. : 5,044,676

DATED : September 3, 1991

INVENTOR(S) : Kevin Burton

It is certified that error appears in the above-identified patent and that said Letters Patent is hereby corrected as shown below:

Title page, item (73):

The name of the Assignee should be changed from "Abbvetco Gray Inc." to --ABB Vetco Gray Inc.--

Signed and Sealed this

Fifteenth Day of June, 1993

*Attest:*

Michael K. Kirk

MICHAEL K. KIRK

*Attesting Officer*

*Acting Commissioner of Patents and Trademarks*